United States Patent [19]

Nishio et al.

[11] 4,427,915

[45] Jan. 24, 1984

[54] SPARK PLUG AND THE PROCESS FOR PRODUCTION THEREOF

[75] Inventors: Kanemitsu Nishio; Shunichi Takagi; Yasuhiko Suzuki, all of Nagoya, Japan

[73] Assignee: NGK Spark Plug Co. Ltd., Aichi, Japan

[21] Appl. No.: 195,734

[22] Filed: Oct. 10, 1980

[30] Foreign Application Priority Data

Oct. 13, 1979 [JP] Japan ..... 54-132139

[51] Int. Cl.[3] ..... H01T 21/02; H01T 1/16

[52] U.S. Cl. ..... 313/141; 313/131 A; 445/7

[58] Field of Search ..... 29/25.12; 313/311, 118, 313/143, 141, 142, 131 A, 130; 252/513, 514, 512; 445/7

[56] References Cited

U.S. PATENT DOCUMENTS

| | | | |
|---|---|---|---|
| 2,265,352 | 12/1941 | Corbin et al. | 29/25.12 X |
| 2,545,438 | 3/1951 | Stumbock | 252/512 X |
| 3,037,140 | 5/1962 | Schurecht | 313/130 X |
| 3,061,756 | 10/1962 | Henderson | 29/25.12 X |
| 3,505,134 | 4/1970 | Short | 252/514 X |
| 3,854,067 | 12/1974 | Morgan | 313/130 |
| 4,001,145 | 1/1977 | Sakai et al. | 252/513 |
| 4,006,106 | 2/1977 | Yoshida et al. | 252/513 |
| 4,144,474 | 3/1979 | Nishio et al. | 313/131 A |
| 4,261,085 | 4/1981 | Nishio et al. | 445/7 |

FOREIGN PATENT DOCUMENTS

| | | | |
|---|---|---|---|
| 941701 | 8/1948 | France | 252/514 |
| 52-18550 | 2/1977 | Japan | 29/25.12 |
| 2729099 | 12/1978 | Fed. Rep. of Germany | 313/142 |

*Primary Examiner*—Kenneth J. Ramsey

*Attorney, Agent, or Firm*—Sughrue, Mion, Zinn, Macpeak and Seas

[57] ABSTRACT

A spark plug with a spark electrode prepared by mixing at least a matrix material of a titanium compound (e.g., $TiO_2$, TiC, TiN, etc.) with an electrical conductivity-imparting substance (e.g., Pt and Pd, or a mixture of Pt, Pd and a noble metal, e.g., Au, Ru, Ag, Rh, etc.) and sintering the resulting mixture.

26 Claims, 5 Drawing Figures

SPARK PLUG AND THE PROCESS FOR PRODUCTION THEREOF

BACKGROUND OF THE INVENTION

1. Field of the Invention

This invention relates to a spark plug with a novel central electrode which is used in an internal combustion engine, and the process for production thereof.

2. Description of the Prior Art

The spark portion of the central electrode of a spark plug (e.g., used in an internal combustion engine) is subject to very severe conditions; for example, the spark portion is exposed to the maximum temperature in a combustion chamber, typically nearly 1,000° C. The spark portion, therefore, is required not only to be durable to such high temperatures, but also to have good mechanical durability with respect to spark discharge and good chemical durability with respect to combustion gases.

It has heretofore been known that platinum, gold and like metals have excellent characteristics as a central electrode material, and in some special spark plugs, a noble metal (e.g., platinum, palladium, gold, silver, etc.) wire electrode has been used. These metals, however, are expensive, and, in general, therefore, a heat-resistant alloy made mainly of nickel is more commonly used. When a spark plug obtained using such a nickel alloy is used for a long period of time, the spark portion of the spark plug becomes worn and the spark gap between electrodes is extended. This gives rise to the problem that the voltage at which the spark discharge occurs is increased to higher levels than that which can be produced by an electric source, and thus no discharge occurs. In order to overcome the above disadvantage and to increase the durability of the spark plug, a spark plug has been proposed in which the central electrode is enveloped in an insulator and the tip spark portion is made electrically conductive has been described in U.S. Pat. No. 2,265,352, etc.

This type of spark plug has increased resistance to being worn out by spark discharge, combustion heat and combustion gases since the electrical conductivity-imparting part comprises an alumina material and platinum dispersed therein. However, it has the following disadvantage:

It is generally difficult to produce a dense and uniform composite of high melting point ceramics and a high melting point metal such as platinum, etc. When a mixed powder of alumina and platinum is sintered, even though it might be sintered in appearance, the product obtained may merely be a mixture comprising alumina with platinum particles dispersed therein, as can be see from a cross-sectional microscopic photographic of such a product, as is illustrated in FIG. 3, i.e., a statistical mixture in which two discrete phases are distributed at random and no continuous matrix phase is formed, since alumina and platinum are chemically inert to each other and their mutual wettability is low. Therefore, when such a product (i.e., a statistical mixture of alumina and platinum) is used as a spark portion of the spark plug electrode and repeatedly exposed to spark discharge, mechanically weak links between the alumina and platinum phases are readily broken, resulting in spattering of the platinum. Thus such a product cannot be used as a spark portion for a long period of time.

SUMMARY OF THE INVENTION

The object of this invention is to provide a spark plug that overcomes the problems described above, and particularly a spark plug having a micro-structure such that an electrical conductivity-imparting substance, e.g., a noble metal, such as platinum, is uniformly and continuously dispersed in titanium compound(s) having good heat resistance, which can be densely and firmly sintered, is excellent in durability, and which prevents the spark portion from being damaged over long periods of time.

The inventors have discovered that a combination of at least a titanium compound, platinum and palladium produces good effects in the sintered density, sintered texture, adhesion strength to an insulator, and durability, and in particular, the use of the titanium compound as a ceramics phase produces marked effects in improvements of the spark portion.

This invention, therefore, provides a spark plug having a spark electrode at the position facing an external electrode, said spark electrode being prepared by mixing at least a titanium compound, e.g., $TiO_2$, TiC, TiN, etc., as a matrix material and an electrical conductivity-imparting substance (e.g., Pt and Pd, or a mixture of Pt, Pd, and a noble metal, e.g., Au, Ru, Ag, Rh, etc.) and then sintering the resulting mixture.

BRIEF DESCRIPTION OF THE DRAWINGS

FIG. 2(*a*) is an enlarged sectional view of a spark portion of the spark plug of FIG. 2;

DETAILED DESCRIPTION OF THE INVENTION

The spark plug of this invention is characterized in that the spark electrode facing the sparking surface of the external electrode of the porcelain insulator is made of ceramics-metal (cermet) composition which is prepared by mixing at least a titanium compound and an electrical conductivity-imparting substance (e.g., Pt and Pd, or a mixture of Pt, Pd, and a noble metal, e.g., Au, Ru, Ag, Rh, etc.). Furthermore, if desired, a base metal, such as iron, nickel, chromium, Ti, Mo, Mn, a Fe-Ni-Cr alloy, etc., oxide such as $Al_2O_3$, $Y_2O_3$, $ZrO_2$, $SiO_2$, $La_2O_3$, $LaCrO_3$, etc., carbide such as $Mo_2C$, TaC, SiC, $B_4C$, $Cr_3C_2$, NbC, etc., and nitride such as AlN, BN, ZrN, etc., and silicide such as $MoSi_2$, CrSi, etc., and then sintering the resulting mixture.

Figure 1:
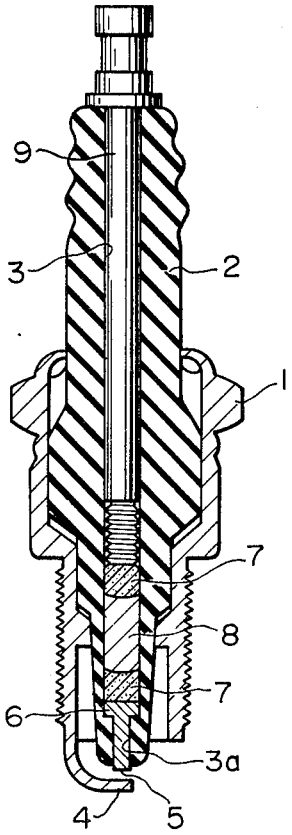
FIG. 1 is a longitudinal sectional view of a spark plug according to this invention.
Figure 2:
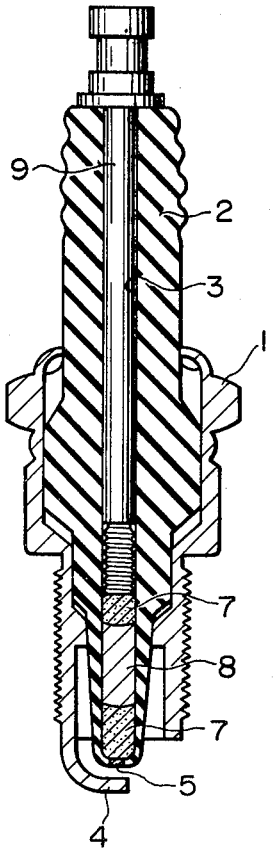
FIG. 2 is a longitudinal sectional view of another spark plug according to this invention.
Figure 2A:
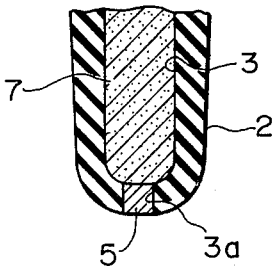

Hereinafter, the spark plug of this invention will be explained in more detail by reference to the embodiments as illustrated in FIGS. 1 and 2.

The spark plug as illustrated in FIG. 1 comprises a metal shell which is provided with an external or ground electrode 4 at one end thereof and is threaded so that it can be attached to an internal combustion engine, a ceramic insulator 2 made mainly (about 90%) of high purity alumina which is placed in and secured to the metal shell 1 and which is provided in the center thereof with a shaft hole 3 constituting a central electrode shaft, and a spark electrode 5 which is formed in a tip hole 3*a* of the insulator 2 facing the external electrode 4.

The spark electrode 5 is previously formed in a bolt-like structure consisting of a shank part and a head part 6 having a larger diameter than that of the shank part and then sintered. Thereafter, the spark electrode 5 is inserted into the tip of the hole of the sintered alumina porcelain insulator 2 and secured therein. On the spark electrode 5 are placed an electrically conductive seal member 7, a resistor 8 and another a seal member 7, all being conventionally used features, and they are combined together in the shaft hole 3 by means of a terminal shaft 9 and heated to form the plug.

In the embodiment as illustrated in FIG. 2 and FIG. 2(*a*), an electrode material in a paste state is placed in the tip hole 3*a* of a green alumina porcelain and sintered together with the alumina porcelain to form a spark electrode in the tip hole and/or the tip hole extending in the shaft hole 3. Thereafter, by the same method as explained by reference to FIG. 1, a seal members 7 and resistor 8 are combined together by use of a terminal shaft 9 and heated to form an insulator.

In the spark electrode, the titanium compound(s) is used as the matrix material, and in the clearances formed among titanium compound particles forming the matrix phase, a noble metal, such as platinum, palladium, gold, silver, etc., and a optionally based metal, such as iron, nickel, Cr, Ti, Mo, Mn a Fe-Ni-Cr alloy, etc., and $Al_2O_3$, $ZrO_2$, $Y_2O_3$, $Fe_2O_3$, MoC, $Mo_2C$, TaC or SiC, are introduced.

In the example described below, composition (1) and (2), the spark electrode were prepared as in the case of the spark electrode of the prior art spark plug, by dispersing platinum particles in alumina particles and sintering the resulting mixture.

Figure 3:
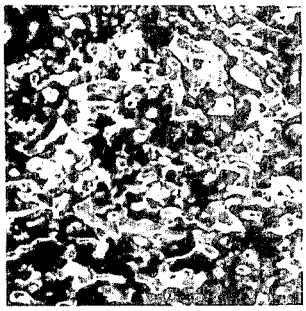
FIG. 3 PRIOR ART
FIG. 3 is a microscopic photograph of the section of a metal-ceramics composite used in the prior art electrode spark portion comprising alumina and platinum.
Figure 4:
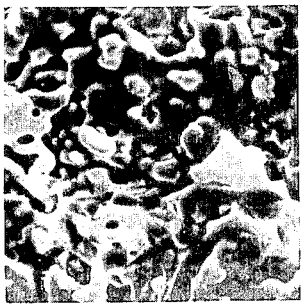
FIG. 4 is a microscopic photograph of a section of a metal-ceramic composite used in an electrode spark portion of a closed porcelain spark plug according to this invention.

In order to increase the durability as compared with the texture as shown in the microscopic photograph of the section of the metal-ceramics composition of FIG. 3, the matrix structure having the form as shown in the microscopic photograph of the metal-ceramics composite of FIG. 4 has been formed.

FIG. 3 shows the microscopic photograph of the section of the Pt-$Al_2O_3$ composition and, the portion where the edge is clear is $Al_2O_3$ and the portion having a little roundness surrounding $Al_2O_3$ is Pt. In this case, since Pt does not enter into clearances among alumina particles, not a few clearances exists.

FIG. 4 shows the microscopic photograph of the section of the Pt-Pd-$TiO_2$-TiC composition, and the adhesion between the matrix material of $TiO_2$-TiC and Pt-Pd is improved, and moreover the wettability between them is improved by the effect of a slight amount of Fe, Ni, Cr.

In producing the spark electrode of the spark plug of this example, as a matrix material, preferably from 10% to 30% by weight of titanium compound particles are used, and as a matrix phase, a mixture of 40 to 60% by weight of platinum particles and 20 to 30% by weight of palladium particles is used, between matrix material and matrix phase 0 to 3% by weight of iron, nickel and chromium particles and additionally, from 0 to 10% by weight of $ZrO_2$, $Y_2O_3$, TaC, $Mo_2C$, MoC, etc. having sintering acceleration effect can be prepared as wrapping matrix phase. Hereinafter the component range (% by weight) referred to for the mixture are those before sintering. The mixture can be sintered independently or simultaneously with the sintering of the insulator.

When the mixture is sintered independently, the starting materials are mixed and then subjected to hot-press under the pressure of 200 kg/cm$^2$ in vacuo at a temperature of 1500° to 1600° C. for 15 minutes; or the starting materials are mixed with a binder such as paraffin, varnish, etc., the resulting mixtures are formed with a mold under the pressure of 500 kg/cm$^2$ and then the molding was sintered in the atmosphere of argon at a temperature of 1500° to 1600° C. for 1 hour to obtain the spark portion 5 of FIG. 1.

When the mixture was sintered simultaneously with the sintering of the insulator, a pellet ($\phi$1 to 2 mm) prepared by molding the mixture of the starting materials and a binder such as varnish, etc. is pressed into the tip hole 3*a* of raw alumina insulator and then the raw alumina insulator is sintered using a tunnel furnace at a temperature of 1550°–1650° C. (maximum temperature) at atmospheric pressure for 30 minutes.

During the sintering, the base metal (iron, nickel and chromium) is oxidized and undergoes chemical reaction with the ceramic phase, and a part of the base metal is alloyed with the noble metal (i.e., the platinum and palladium). As a result, the noble metal phase comes into intimate contact with the ceramics phase and forms a dense and firm matrix texture. Therefore, there can be obtained the spark electrode having the texture as shown in FIG. 4 which is markedly dense and increased in durability in comparison with the prior art texture as shown in FIG. 3.

In order to form the spark electrode having the texture as shown in FIG. 4, as the starting materials, the mixture of the ceramic powder and metal powder are well ground pinching them in the form of slurry between a pair of base metal plates such as stainless metal plate, if necessary, adding water to such an extent that so called mechanochemical effect occurs. The surface was activated by the chemical mixture described above and the sintering is easy to occur, the bond strength is increased. Each component powder except for the noble metal is preferably below 100 microns. In particular, the base metal particles (e.g., iron, nickel, chromium, etc.) are desirably below 10 microns. Addition of palladium, gold, or a gold-palladium alloy having a lower melting point than platinum to the platinum causes liquid phase sintering and is effective in making the sintered product more dense. In the ceramic phase, on the other hand, addition of a mixture of several titanium compounds (e.g., $TiO_2$ and TiC, TiN and TiC, etc.), or $Al_2O_3$, $Y_2O_3$, $ZrO_2$, MoC, $Mo_2C$, TaC, etc., is effective in making dense.

EXAMPLE

As the composition of the metal-ceramics composite (sintered) constituting the spark electrode of the spark plug, the following phases were assumed.

Phase I: Noble Metal . . . Pt, Pd, Ru, Rh, Au, Ag

Phase II: Base Metal . . . Fe, Ni, Cr, Ti, Mo, Mn, Fe-Ni-Cr

Phase III: Non-oxide Ceramic . . . MoC, $Mo_2C$, TaC, Sic, $B_4C$, $Cr_3C_2$, AlN, BN, ZrN Phase IV: Oxide . . . $Al_2O_3$, $Cr_2O_3$, $Y_2O_3$, $ZrO_2$, $SiO_2$, $La_2O_3$ Phase V: Titanium Compound . . . $TiO_2$, TiC, TiN Spark plugs according to this invention were prepared by simultaneous sintering by the following procedure.

An electrode material in a paste form was filled in the tip hole 3a of the shaft hole 3 of the high purity alumina insulator which was press-molded, but not calcined, and heated in air in a baking oven at 1,650° C. (maximum temperature) to produce a product in which the electrode and insulator were combined together. Thereafter, 0.3 g of a conventionally used electrically conductive seal member (boron silicate glass comprising 60% of a Cr component and the remainder consisting of 65% of $SiO_2$, 30% of $B_2O_3$ and 5% of $Al_2O_3$) was filled on the spark electrode in the shaft hole of the insulator, and then the terminal shaft was inserted thereinto. They were heated at 800° C. to 1,000° C. while applying a pressure of 15 kg/cm$^2$, and then cooled to obtain an insulator containing a central electrode. By producing a spark between a pair of the spark electrodes of the insulator faced to each other, a spark discharge test was performed. In this case, the heat-resistance of the seal member was controlled by increasing the metal content or adding powders of $Al_2O_3$, SiC, and the like.

(1) Pt-$Al_2O_3$ (Phase I-Phase IV) or Pd-$Al_2O_3$ (Phase I-Phase IV)

The amount of Pt or Pd added was controlled to from 40% to 90% by weight. As Pt powders, those having a particle size in the range of from 1 to 100 microns were used. A 100% $Al_2O_3$ powder, an $Al_2O_3$ powder having the same composition as the insulator (90% $Al_2O_3$-10% $SiO_2$, MgO, CaO) and additionally, those $Al_2O_3$ powders prepared by adding a Pd powder, Au, Ag, Ru and Rh to the above described powders were used as $Al_2O_3$ powders.

In the above case, when only Pt was used, Pt particles were merely dispersed in the alumina. On the other hand, when only Pd having a melting point of 1,554° C. was used, the Pd was made spherical. Therefore, when in the noble metal phase, Pt was replaced by Pd, Au, Au-Pd, or the like, the phase changed from the one in which the Pt was merely dispersed, to one in which Pt alloy entered into clearances among alumina particles. In this case, however, when the spark discharge test was conducted, a discharge hole was observed in the surface of the spark electrode in a relatively short period of time.

(2) Pt-Fe-$Al_2O_3$ (Phase I-Phase II-Phase IV)

When Fe is added excessively or the particle size of the Fe is large (10 microns or more), the composite electrode becomes fragile under the influence of oxidized Fe. It is, therefore, necessary to add Fe in a suitable amount. When the amount of Fe is added to such an extent that the insulator is colored somewhat brown near the boundary between the spark electrode and insulator (several percent or less) and the particle size of Fe is 10 microns or less, the adhesion between the electrode material and insulator is improved, and moreover the strength of the electrode spark portion was increased. As a result of spark discharge test, however, some discharged holes were observed.

The same phenomenon as above was observed in the case of Cr, Co, etc. A Fe-Ni-Cr alloy suffered less from the occurrence of this phenomenon.

(3) Pt-$TiO_2$ (Phase I-Phase V)

Where only $Al_2O_3$ was used in the ceramics phase, when the spark discharge test was conducted, some discharged holes were observed in the surface of the sintered electrode. However, where only $TiO_2$ was used, some improvement was observed. Although it is not still clear why $TiO_2$ produces such an effect, it is believed that $TiO_2$ has a greater stability than $Al_2O_3$ and that its crystal form produces the observed effect.

(4) Pt-Fe-$TiO_2$ (Phase I-Phase II-Phase V)

When Fe is added to the Pt-$TiO_2$ system, a sintered product similar to that in Example (3) is obtained. The addition of Fe increases the adhesion between the sintered electrode and insulator. The bond strength between Pt and $TiO_2$ is increased.

(5) Pt-Fe-SiC-$TiO_2$ (Phase I-Phase II-Phase III-Phase V)

When SiC is added to the Pt-Fe-$TiO_2$, the sintered density is increased in comparison with Example (4).

(6) Pt-Fe-$Al_2O_3$-$TiO_2$ (Phase I-Phase II-Phase IV-Phase V)

The use as ceramics of titanium compounds (e.g., $TiO_2$, TiC, TiN, etc.) is effective in making dense the sintered electrode. Particularly effective among the above compounds are TiC and a mixture of $TiO_2$ and TiC.

The sintered spark portion of the Pt-Pd-Fe-$Al_2O_3$-$TiO_2$-TiC is markedly improved in comparison with that of the Pt-Pd-Fe-$Al_2O_3$.

While the invention has been described in detail and with reference to specific embodiments thereof, it will be apparent to one skilled in the art that various changes and modifications can be made therein without departing from the spirit and scope thereof.

What is claimed is:

1. A spark plug having a spark electrode at a position thereof facing an external electrode wherein said spark electrode is prepared by mixing at least a titanium compound and a noble metal selected from a group consisting of Pt, a mixture of Pt and Pd, or a mixture of noble metals consisting of (a) a member selected from a group consisting of Pt and Pd and (b) at least one member selected from a group consisting of Au, Ru, Ag and Rh, forming the resulting mixture into the shape of a spark electrode, and then sintering the mixture, wherein the titanium compound is the major ceramic component of the spark electrode.

2. A spark plug having a spark electrode at a position thereof facing an external electrode wherein said spark electrode is prepared by mixing from 10% to 30% by weight of titanium compound powder, from 40% by 60% by weight of a platinum powder, and from 20% to 30% by weight of a palladium powder, forming the resulting mixture into the shape of a spark electrode, and then sintering the mixture.

3. A spark plug as in claim 1 wherein the mixture comprising the titanium compound and the noble metal is placed in a tip hole of a hollow porcelain insulator and sintered together with the hollow porcelain insulator to produce the spark electrode.

4. A spark plug as in claim 1 or 3 wherein at least one member selected from (1) a base metal selected from Fe, Ni, Cr, Ti, Mo, Mn or a Fe-Ni-Cr alloy, (2) an oxide selected from $Al_2O_3$, $Y_2O_3$, $ZrO_2$, $SiO_2$, $La_2O_3$ or $LaCrO_3$, (3) a carbide selected from $Mo_2C$, TaC, SiC, $B_4C$, $Cr_3C_2$ or NbC, (4) a nitride selected from AlN, BN or ZrN, and (5) a silicide selected from $MoSi_2$ and CrSi, is added to the mixture of the titanium compound and the nobel metal prior to sintering.

5. A spark plug as in claim 4 wherein the mixture used for the spark electrode additionally comprises base metal selected from Fe, Ni, Cr, Ti, Mo, Mn or a Fe-Ni-Cr alloy in an amount up to 3% by weight; and an oxide selected from $Al_2O_3$, $Y_2O_3$, $ZrO_2$, $SiO_2$, $La_2O_3$ or $LaCrO_3$, a carbide selected from $Mo_2C$, TaC, SiC, $B_4C$, $Cr_3C_2$ or NbC, a nitride selected from AlN, BN or ZrN and silicide selected from $MoSi_2$ or CrSi, or a mixture thereof, said oxides, carbides nitrides and silicides being present in a total amount up to 10% by weight.

6. A spark plug as in claim 4 wherein the particles of the noble metal have an average diameter of less than 100 microns.

7. A spark plug as in claim 4 wherein the particles of the base metal have an average diameter of less than 10 microns.

8. A spark plug as in claim 3, wherein the titanium compound comprises at least one member selected from the group consisting of $TiO_2$, TiC, and TiN.

9. A spark plug as in claim 1 wherein the titanium compound is selected from the group consisting of $TiO_2$, TiC, and TiN.

10. A spark plug as in claim 9 wherein the titanium compound is TiC.

11. A spark plug as in claim 9 wherein the titanium compound is a mixture of $TiO_2$ and TiC.

12. A spark plug as in claim 9 wherein the titanium compound is a mixture of TiN and TiC.

13. A spark plug as in claim 1 wherein the titanium compound comprises at least one member selected from the group consisting of $TiO_2$, TiC, and TiN.

14. A process for producing a spark plug comprising a spark electrode prepared by mixing at least a titanium compound selected from $TiO_2$, TiC, or TiN and a noble metal selected from a group consisting of Pt, a mixture of Pt and Pd, or a mixture of noble metals consisting of (a) a member selected from a group consisting of Pt and Pd and (b) at least oe member selected from a group consisting of Au, Ru, Ag and Rh to form a slurry, grinding the slurry placed between a pair of base metal plates while adding water, drying the ground slurry to form a paste, forming the resulting paste in the form of a pellet with a binder, filling the pellet in the tip hole of a hollow porcelain insulator, sintering the spark electrode material simultaneously with the sintering of the hollow porcelain insulator to produce a product in which the spark electrode and the hollow porcelain insulator are combined together, placing an electrically conductive seal member, a resistor and another seal member, compacting them together in the shaft hole by means of a terminal shaft, and heating them to form the plug, wherein the titanium compound is the major ceramic component of the spark electrode.

15. A process for producing a spark plug as in claim 14 wherein at least one member selected from (1) a base metal selected from Fe, Ni, Cr, Ti, Mo, Mn, and a Fe-Ni-Cr alloy, (2) an oxide selected from $Al_2O_3$, $ZrO_2$, $SiO_2$, $La_2O_3$ or $LaCrO_3$, (3) a carbide selected from $Mo_2C$, TaC, SiC, $B_4C$, $Cr_3C_2$ or NbC, (4) a nitride selected from AlN, BN or ZrN, and a silicide selected from $MoSi_2$ and CrSi, is added to the mixture of the titanium compound and the noble metal prior to sintering.

16. A process for producing a spark plug as in claim 14 or 15 wherein the titanium compound comprises at least one member selected from the group consisting of $TiO_2$, TiC, and TiN.

17. A process for producing a spark plug as in claim 15 wherein the mixture used for the spark electrode additionally comprises base metal selected from Fe, Ni, Cr, Ti, Mo, Mn and a Fe-Ni-Cr alloy, in an amount up to 3% by weight; and an oxide selected from $Al_2O_3$, $Cr_2O_3$, $Y_2O_3$, $SiO_2$, $LaCrO_3$, a carbide selected from $Mo_2C$, TaC, SiC, $B_4C$, $Cr_3C_3$ or NbC, a nitride selected from AlN, BN or ZrN and a silicide selected from $MoSi_2$ or CrSi, or a mixture thereof, said oxides, carbides, nitrides and silicides being present in a total amount up to 10% by weight.

18. A process for producing a spark plug as in claim 14 wherein the mixture used for the spark electrode comprises from 10% to 30% by weight of titanium compound powder, from 40% to 60% by weight of a platinum powder, and from 20% to 30% by weight of palladium powder.

19. A process for producing a spark plug as in claim 14 wherein the particles of the noble metal have an average diameter of less than 100 microns.

20. A process for producing a spark plug as in claim 14 wherein the particles of the base metal having an avelage diameter of less than 10 microns.

21. A process for producing a spark plug as in claim 14 wherein the titanium compound is TiC.

22. A process for producing a spark plug as in claim 14 wherein the titanium compound is a mixture of $TiO_2$ and TiC.

23. A process for producing a spark plug as in claim 14 wherein the titanium compound is a mixture of TiN and TiC.

24. A process for producing a spark plug as in claim 14 wherein the sintering is achieved at a temperature of 1550° to 1650° C. at atmospheric pressure for 30 minutes.

25. A process for producing a spark plug as in claim 14 wherein the binder is varnish.

26. A spark plug having a spark electrode at a position thereof facing an external electrode wherein said spark electrode is prepared by mixing from 10% to 30% by weight of titanium compound powder, from 40% to 60% by weight of a platinum powder, and from 20% to 30% by weight of a palladium powder, forming the resulting mixture into the shape of a spark electrode, and then sintering the mixture.

* * * * *